US006312137B1

(12) United States Patent
Hsieh

(10) Patent No.: US 6,312,137 B1
(45) Date of Patent: Nov. 6, 2001

(54) STRUCTURE OF THE ORNAMENT LAMP

(76) Inventor: Hua Lung Hsieh, No. 27, Lane 384, Lung Chiang Rd., Taipei (TW)

( * ) Notice: Subject to any disclaimer, the term of this patent is extended or adjusted under 35 U.S.C. 154(b) by 0 days.

(21) Appl. No.: 09/686,859

(22) Filed: Oct. 12, 2000

(51) Int. Cl.[7] ..... F22V 33/00

(52) U.S. Cl. ..... 362/96; 362/294; 362/806; 40/428

(58) Field of Search ..... 362/96, 294, 373, 362/806, 396; 40/412, 428, 431, 436, 439, 441; 392/348; 475/65

(56) References Cited

U.S. PATENT DOCUMENTS 1,824,388 * 9/1931 Birch ..... 40/439
3,603,013 * 9/1971 Reed ..... 40/428
5,683,167 * 11/1997 Tarlow ..... 362/96

* cited by examiner

*Primary Examiner*—Y. Quach
(74) *Attorney, Agent, or Firm*—Rosenberg, Klein & Lee

(57) ABSTRACT

The invention relates to a improvement of the structure of the ornament lamp, it mainly comprises a ornament lamp stand, a upward open shape lamp cover body is disposed on the ornament lamp stand, wherein a supporting rack is disposed in the lamp cover body, and a ventilation fan is disposed on the supporting rack in sequence, a hollow rack body is also installed on the ventilation fan, besides, a flange is located at the edge of the bottom of the rack to be screwed on the ventilation fan and the rack by a bolt, the center of the bottom of said rack is a fixing plane to fix a bulb stand, the bulb stand is utilized to fix a bulb thereon, a net frame is disposed to cover over the bulb and is fixed on said rack with bolts, then a proper dimension of hollow-out net face is disposed at the center of the frame to let light penetrate and air flow, in addition, multiple fixing devices is installed at the circumference of the frame to fix a arbitrary shape cloth.

5 Claims, 3 Drawing Sheets

STRUCTURE OF THE ORNAMENT LAMP

FIELD OF INVENTION

The present invention relates to an improvement of the structure of the ornament lamp, and more particularly is an ornament lamp installed with a ventilation fan and a cloth, a flow of air is formed by the way of the rotation of the ventilation fan, causing the cloth to flutter due to the driving of the airflow and shadow to sway while lamp is projected on the cloth so as to form the effect of torch-like burning.

BACKGROUND OF THE INVENTION

According to the ornament lamp of the present time, more particularly to the reflecting type of lamp, it mainly projects light upwards onto the ceiling by the way of reflection, then reflects light therefrom to everywhere in the room so as to provide a more soft and comfortable illumination effect in the room. But, to such kind of ornament lamp used in the room, it only provides the single illumination as mentioned before, manufacturers can only take different types of lamps as the difference to manufacture and sell, customers choose only different appearances and types of lamps to buy as well upon shopping, therefore, it is difficult to provide the products which have outstanding and special property for customers so as to be distinguished from other products, causing it to be a bottleneck which is impossible to breakthrough by ornament lamp manufacturers in selling and manufacturing.

OBJECTS, SUMMARY, AND ADVANTAGES OF THE INVENTION

Therefore, how to provide a ornament lamp which have the ability to illuminate but also have other functions in order to expand the efficacy and the scope of the use of the present ornament lamps is the problem that the inventor wanted to solve as soon as possible. After numerous trials and errors of the inventor of the present invention and finally, the present invention comes out.

The main purpose of the present invention is to provide an improvement of the structure of the ornament lamp, mainly enabling the ornament lamp of the current type to yield an torch-like illumination effect, in other words, enabling it to provide the effect of illumination, and the effect of visual pleasure to current customers.

The another purpose of the present invention is to provide a improvement of the structure of the ornament lamp, it is mainly installed a ventilation fan in the lamp cover, and a cloth is disposed over the bulb, so as to drive the cloth to flutter by the rotation of the ventilation fan to yield a torch-like effect while light is projected onto the cloth.

Additional objects, features and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
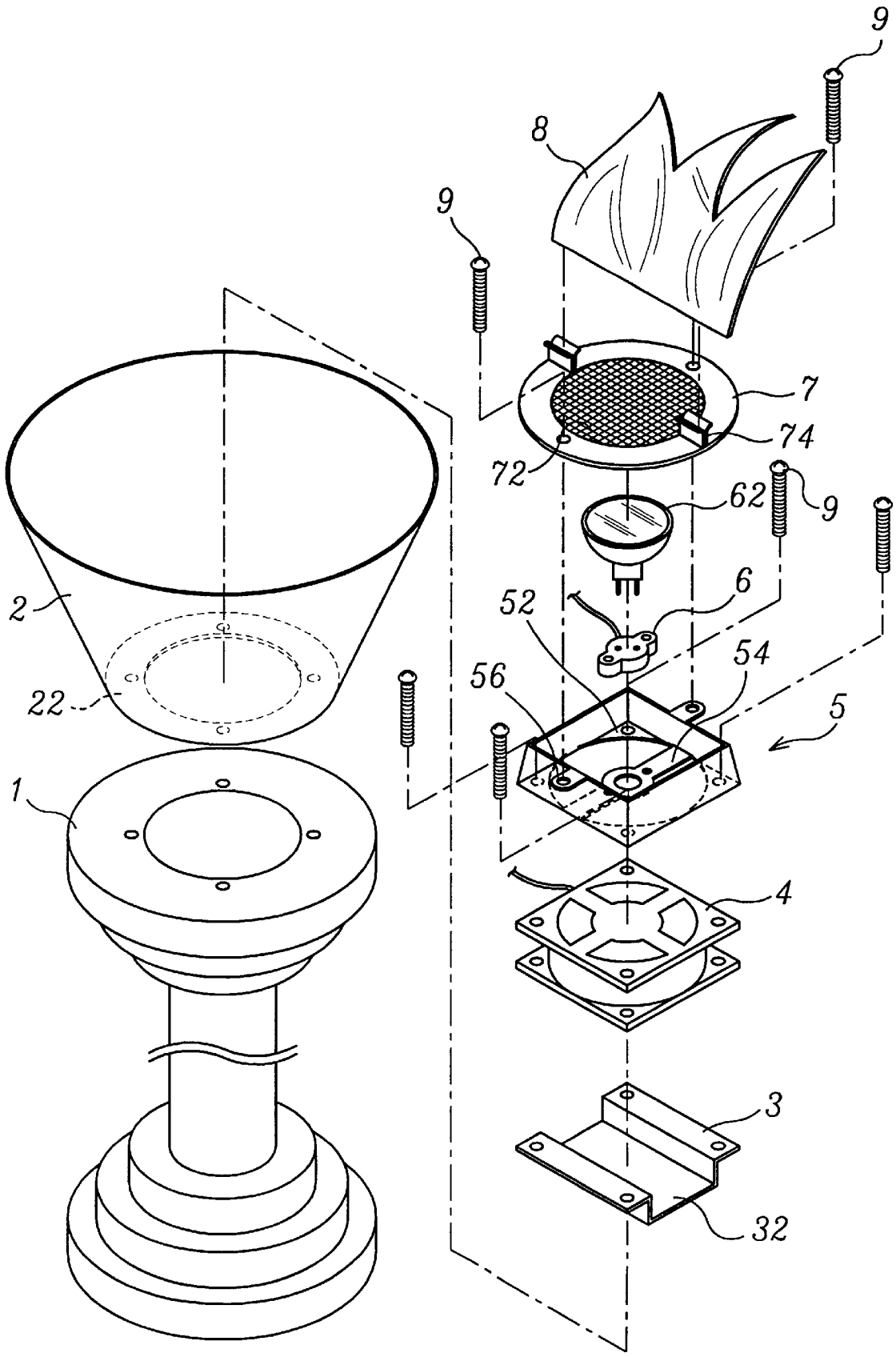
FIG. 1 is an explosive view ofthe present invention.
Figure 2:
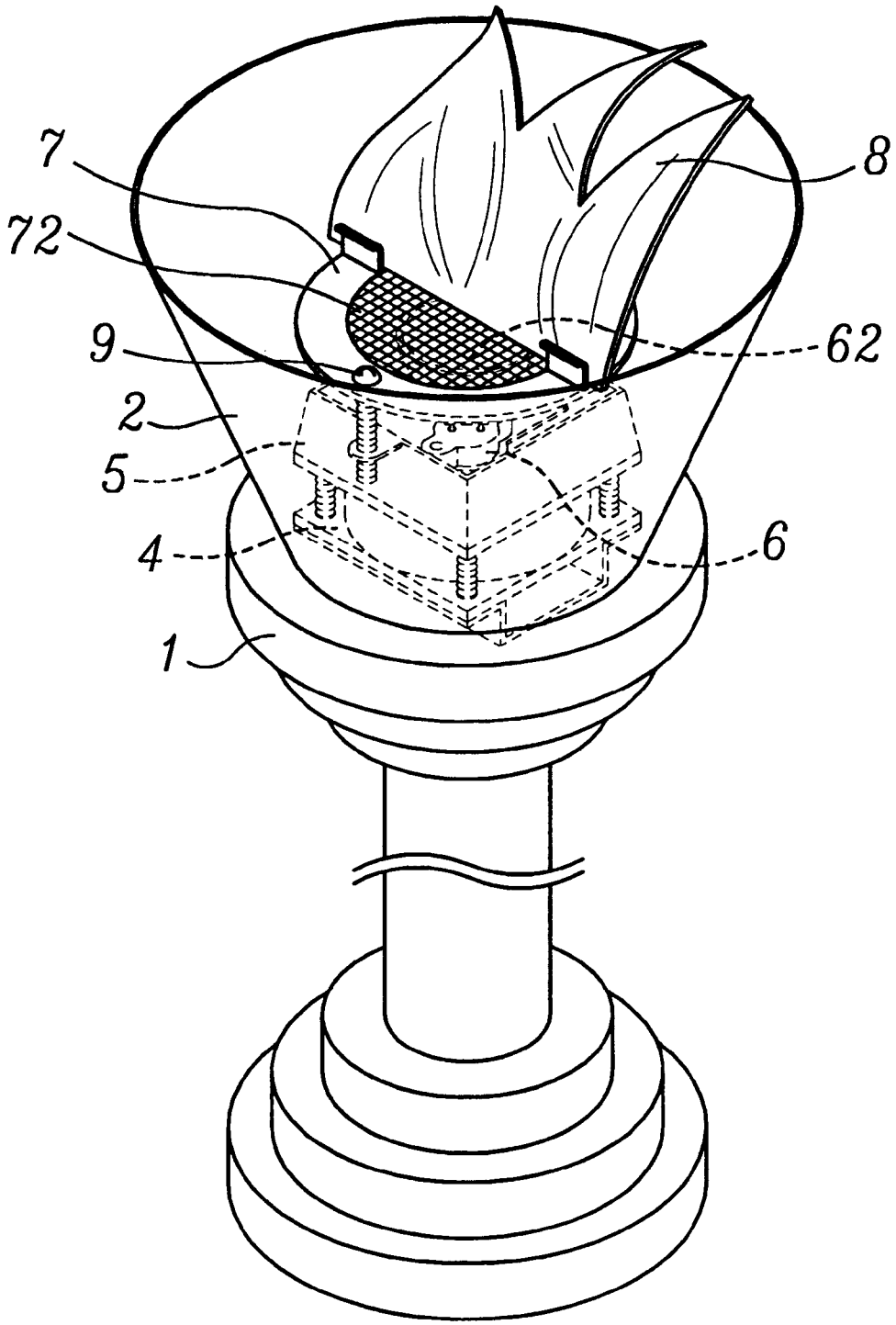
FIG. 2 is a perspective view of the present invention.

Referring first to FIG. 1 and FIG. 2 respectively, the invention is mainly to have an ornament lamp stand 1 to be installed, and an upward-open-shaped lamp cover body is disposed on the ornament lamp stand 1, a fixing flange 22 is disposed at the circumference of the bottom end of the lamp cover body 2 so as to let it be fixed at the upper end of the ornament lamp stand 1, a supporting rack 3 is also disposed in the lamp cover body 2, a groove 32 is formed downward at the center of the supporting rack x3, and a ventilation fan 4 is installed on the supporting rack 3 in sequence, a hollow rack body 5 is also disposed on the ventilation fan 4, wherein the profile of the rack body 5 is approximately assumed cone shape, a flange 52 located at each corner of the bottom end of the rack body 5 is separately screwed onto the ventilation fan 4 and the rack body 3 by a bolt 9, a fixing plane 54 is installed at the center of the bottom of the rack body 5 to fix a bulb stand 6, the bulb stand 6 is utilized to fix a bulb 62 thereon, further, a net frame 7 is disposed to cover over the bulb 62, enabling it to be able to be fixed on the fixing convex sheet 56 installed at the flank side of the rack body 5 by bolts 9, then a proper dimension of hollow-out net face 72 is disposed at the center of the frame 7 to let the light penetrate and the air flow, in addition, multiple fixing devices 74 are installed at the circumference of the frame 7 to fix at least an arbitrary shape of cloth 8, wherein the soft material for the cloth 8 is the best, and the fixing device 74 may be a clamping seat to clamp the cloth 8 therein, or any other ways to fix the cloth 8 on the net frame 7 is fine.

Figure 3:
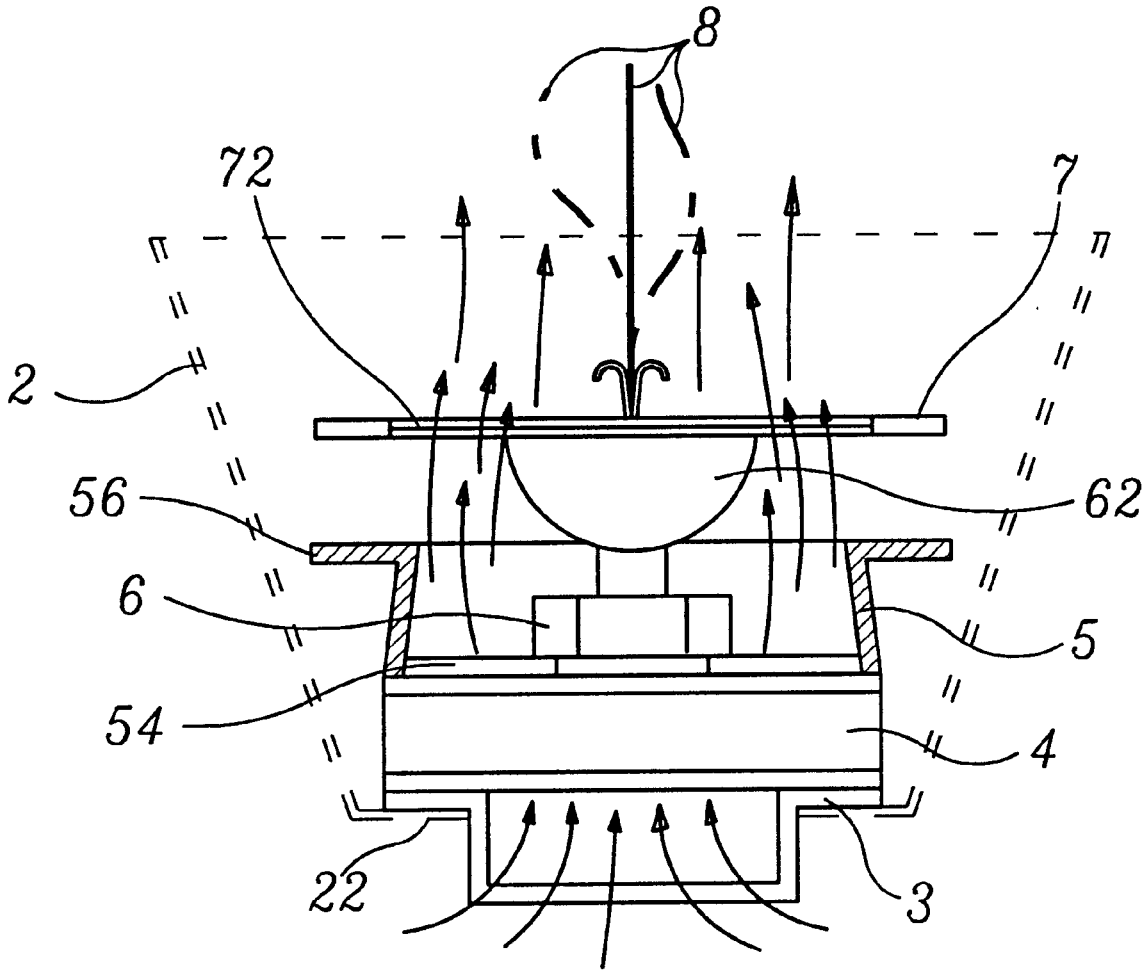
FIG. 3 is a perspective view that shows the flutter of the cloth driven by the airflow in the lamp.

Meanwhile, referring now to FIG. 3, upon practical use, the invention mainly yields an air force to drive an airflow to flow during the ventilation fan 4 is rotating, causing the flowing airflow to be able to pass separately through the rack body 5 and the net frame 7 and flows upward so as to drive the cloth 8 on the net frame to generate a continuous state of shivering and fluttering, at the same time, the bulb 62 below the net frame may emit light beams to pass through a net face 72 of the net frame 7 so as to project on the cloth 8, causing the shivering and fluttering cloth 8 driven by the airflow to operate in coordination with the projecting light to yield a torch-like frame burning effect, enabling the ornament lamp to yield a specially interesting effect on vision; of course the ventilation fan 4 mentioned above not only have the function to yield an air force to drive the cloth 8 to flutter but also have the effect to ventilate the bulb 62 so as to avoid the cloth 8 from overheating to burn to cause the state of danger.

The above disclosure is not intended as limiting. Those skilled in the art will readily observe that the numerous modifications and alternations of the device may be made while retaining the teachings of the invention. Accordingly, the above disclosure should be construed as limited only by the metes and bounds of the appended claims.

What is claimed is:

1. An ornament lamp, comprising an ornament lamp stand, an upward open shape lamp cover body disposed on said ornament lamp stand, wherein a supporting rack is disposed in said lamp cover body, a ventilation fan is disposed on said supporting rack, a hollow rack body is installed on said ventilation fan, a flange is located at an edge of a bottom of said rack body to be screwed on said ventilation fan and said rack by a bolt, a fixing plane is disposed in a center of the bottom of said rack body, a bulb stand is fixed on said fixing plane, a bulb is fixed on said bulb stand, a net frame is disposed to cover over said bulb and is fixed on said rack body with bolts, a hollow-out net face is disposed at a center of said frame to let the light penetrate through the net face and the air flow through the net face, multiple fixing devices are installed on a circumference of said frame, a cloth of arbitrary shape is fixed to said devices.

2. The ornamental lamp of claim 1, wherein the material of said cloth is made of a soft material.

3. The ornamental lamp of claim 1, wherein a groove is formed downward at a center of the supporting rack.

4. The ornamental lamp of claim 1, wherein each of said fixing devices comprised of a clamping seat to clamp the cloth therein.

5. The ornamental lamp of claim 1, wherein an air force is yielded to drive an airflow to flow during the ventilation fan is rotating, causing the flowing airflow to be able to pass separately through the rack body and the net frame and flows upward so as to drive the cloth on the net frame to continuously shiver and flutter.

* * * * *